US007290558B2

(12) United States Patent
DeChard et al.

(10) Patent No.: US 7,290,558 B2
(45) Date of Patent: Nov. 6, 2007

(54) MODULAR AND MOBILE WASTE AND/OR HAZARDOUS LIQUID CONTAINMENT AND COLLECTION SHOWER SYSTEM

(76) Inventors: Albert DeChard, P.O. Box 271852, Tampa, FL (US) 33688-1852; Charles D. Siminski, 10910 Winter Oak Pl., Tampa, FL (US) 33624

( * ) Notice: Subject to any disclaimer, the term of this patent is extended or adjusted under 35 U.S.C. 154(b) by 183 days.

(21) Appl. No.: 11/211,341

(22) Filed: Aug. 25, 2005

(65) Prior Publication Data

US 2007/0044839 A1 Mar. 1, 2007

(51) Int. Cl.
*E03B 7/08* (2006.01)

(52) U.S. Cl. ..... 137/312; 137/561 R; 222/108; 220/571; 220/573

(58) Field of Classification Search ..... 137/312, 137/561 R, 362, 561 A, 565; 220/571, 573; 222/108, 111; 141/86; 180/69.1; 296/38
See application file for complete search history.

(56) References Cited

U.S. PATENT DOCUMENTS

| | | | | |
|---|---|---|---|---|
| 3,032,062 | A | 5/1962 | Blahnik | |
| 3,304,950 | A | 2/1967 | Hubert | |
| 4,484,661 | A * | 11/1984 | Evenson | 184/106 |
| 4,537,217 | A | 8/1985 | Allen, Jr. | |
| 4,552,166 | A | 11/1985 | Chadbourne Sr., et al. | |
| 4,679,590 | A | 7/1987 | Hergenroeder | |
| 4,684,562 | A | 8/1987 | Hartkemeyer | |
| 4,729,404 | A | 3/1988 | Hergenroeder | |
| 4,875,537 | A | 10/1989 | Garnatz et al. | |
| 5,020,638 | A | 6/1991 | Smith | |
| 5,128,189 | A | 7/1992 | Bartlett | |
| 5,199,457 | A | 4/1993 | Miller | |
| 5,419,945 | A | 5/1995 | Lopez | |
| 5,478,625 | A | 12/1995 | Wright | |
| 5,492,158 | A | 2/1996 | Haag | |
| 5,560,782 | A | 10/1996 | Latimer | |
| 5,738,139 | A | 4/1998 | DeChard | |
| 6,305,569 | B1 * | 10/2001 | Bierce et al. | 220/573 |
| 6,568,419 | B1 * | 5/2003 | Robinson et al. | 137/312 |
| 7,017,313 | B1 * | 3/2006 | Mueller | 137/312 |
| 7,051,748 | B2 * | 5/2006 | VanBasten | 137/312 |
| 7,124,772 | B1 * | 10/2006 | Browning | 137/312 |

* cited by examiner

*Primary Examiner*—Kevin Lee
(74) *Attorney, Agent, or Firm*—Larson & Larson; Herbert W. Larson

(57) ABSTRACT

A waste water and hazardous chemical collection system is provided. The system includes a bottom pan having a plurality of vertically disposed walls, a multitude of outwardly horizontally projecting ledges and a plurality of downwardly depending lips. Each pan further includes a drainage waffle inserted within said pan. A work surface is applied to a top surface of said drainage waffle. A plurality of holes is formed in said work surface permitting any liquids that make contact to the work surface to drain there through and into an area of the bottom pan. A pump is connected to said pan for withdrawing liquids therefrom. The system includes a water source for each pan thereby creating a shower system.

18 Claims, 7 Drawing Sheets

MODULAR AND MOBILE WASTE AND/OR HAZARDOUS LIQUID CONTAINMENT AND COLLECTION SHOWER SYSTEM

BACKGROUND OF THE INVENTION

1. Field of Invention

The present invention relates to hazardous and/or waste liquid collection and containment. More particularly, it relates to a modular and mobile shower system for capturing, containing and collecting hazardous liquids and/or waste water resulting from leaks or from a rinsing procedure of people, machines or other objects that emit or have adhered thereto, substances that are hazardous to the environment if allowed to run-off.

2. Description of the Prior Art

Hazardous liquid and waste water collection is known in the prior art. Due to rising concerns that the environment is becoming polluted at an alarming rate by hazardous chemicals, governments, both State and Federal, and those in other countries have begun mandating that water runoff from shower and rinsing procedures be contained and collected for proper disposable to avoid further contamination of the environment. For instance, the simple process of cleaning a piece of machinery that uses solvents, in its capacity to operate must now be cleaned, in most locales, in a controlled rinsing facility or shower system that collects and contains the water used during the cleaning procedure. This waste water is no longer allowed to simply enter the sewer system or run off into the underground aquifer or nearest body of water. Even more simply, the washing of trucks and automobiles, in many locations, now requires that the rinse water be captured, contained and disposed of properly.

An effective waste water collection system is seen in U.S. Pat. No. 5,738,139 wherein a containment substrate, or ground cover, applied to a work area includes a water impervious barrier having a drainage waffle located within defined framed area, and a non-skid work surface placed on top. The non-skid work surface contains holes which allow water to pass through the work surface and be collected within the area of the drainage waffle by the water impervious barrier. A pump is in communication with said water imperious barrier and withdraws the waste water during and/or after a rinsing procedure is completed. This invention is extremely useful for work areas that are non-mobile, like, for instance, a car washing facility, wherein cars are driven on top of the large mat-like apparatus. However, if the needs of the user are mobile, or if the apparatus needs to be expanded, due to the object to be rinsed being larger than what the apparatus can handle, a problem arises. It is not easily modifiable. This invention however works extremely well for rinsing procedures wherein the size of the target object to be rinsed is predictable, the same each time or always located in the same place. On the other hand, this system is not easily made mobile nor does it have the ability to be modular without making alterations to the overall design of the device once constructed. Alterations can be made, but requires an increase in overhead costs and a delay in use of the apparatus thereby temporarily disabling the ability to generate a stream of income from said apparatus.

Other problems with hazardous liquid and waste water containment and collection have also recently arisen as to wars, crime, terrorism and environmental accidents. In particular, it is not uncommon for businesses, public facilities and land areas to be exposed or infected to deadly biological or chemical substances that are extremely hazardous to remove. These affected areas need to be cleaned with direct human intervention. One will recall a string of biological terrorist attacks that occurred in the United States in late 2001 and early 2002 wherein anthrax spores were mailed utilizing the United States Postal Service. These anthrax spores were found to be prevalent in a US Post Office in Florida. That office was subsequently closed and condemned as infected with Anthrax until it could be properly cleaned. People, skilled in the knowledge of hazardous material clean-up, had to go to the location and clean the facility.

During a cleaning procedure as mentioned directly above, the people involved must wear protective suits. These individuals typically work in shifts of two people for twenty minutes each, for example. When their shift is completed, they must be thoroughly cleansed before they can remove their protective wear. They are cleansed in an area designated as the "Hot Zone". In these Hot Zones, showers need to be set up to cleanse the workers. However, to allow the rinse water to simply run off and into ground or sewer would be self-defeating and negate the reason for cleaning the affected area in the first place. These shower systems are commonly used by the groups designated as HAZMAT, an acronym for "Hazardous Material". HAZMAT groups are typically organized under a local fire department or crisis reaction team in any given town, city or state.

To date, the prior art lacks a system which can adequately handle the necessary capture, collection and containment of the waste water resulting from hazardous clean-up showers, such as those required in a Hot Zone. The deficiencies seen in the prior art include a lack of any system which can be quickly deployed and/or enlarged at a moment's notice. This deficiency could prove to be critical in the event of a large scale biological terrorist attack. In such scenario, Hot Zone showers would need to be installed rapidly, efficiently and be adaptable to changing conditions. If a large scale attack occurred, it may be necessary to enlarge or even scale back the shower system once the experts understand what they are dealing with. It would not be surprising to have an attack at one location and then another attack in some other location. Terrorists have shown this to be a familiar pattern. If the first location is cleansed and secure, HAZMAT would want to dissemble the shower system at the first location and rapidly reassemble it at the other location. This would prove to be difficult or impossible with the existing state of the art. Clearly, an improvement in the art is needed.

Further to the occurrence of biological or chemical attacks or accidents, if a large portion of society was exposed, it is obvious that those infected would seek immediate medical attention inundating hospitals and other emergency facilities. The people infected may end up exposing a large percentage of the health care providers whose help they seek if not properly cleansed prior to examination or treatment. Accordingly, a need exists for a shower system that can be installed quickly and efficiently at the triage or entry level of all emergency facilities and hospitals. No such system exits in the prior art. Nor does a system exist that can be modified rapidly to accommodate a rising number of patients over a short time period. An improvement in the prior art is necessary to handle these critical threats and actual occurrences.

Other problems exist with hazardous liquid capture and containment. There is a need for collection systems that can be placed "in-line" in facilities of all types. For instance, when transferring hazardous liquids from fifty-five gallon drums, it is not uncommon to have spills or leaks. It would therefore be useful to have a system which could capture these liquids, contain them and even recycle them back into said drums (a so-called secondary containment system as mandated by EPA regulations for transferring harmful liquids). Further, there exists a need for systems that can be employed in the food industry underneath refrigerator, freezers and meat lockers, for example. In the case of a power outage, water and other liquids that could be hazardous to the contents of said coolers need to be contained, kept separate from said food and disposed of properly. Still further, a need exists for a system which can be employed in the medical field to capture and contain drugs, blood, body parts and internal organs of both humans and animals in a multitude of medical and vetinenarian procedures.

SUMMARY OF THE INVENTION

I have invented an improved hazardous liquid and/or waste water capture, collection, and containment shower system. My improved system is both modular and extremely mobile. Accordingly, it can be quickly employed and removed in a desired location. The system employs small modular and light-weight pans constructed from a liquid impervious material. Each pan has a bottom layer and four integrally attached upstanding walls. Each wall has a horizontally disposed outwardly extending ledge and a downwardly depending lip which permits any one pan to affix to any one adjoining pan. Of the four lips, each pan has two wide-lipped sides and two narrow-lipped sides. When two pans are connected, a wide-lipped side of one pan attaches and overlaps to a narrow-lipped side of an adjoining pan thereby interlocking two pans. Since each pan is light weight, a hazardous liquid and/or waste water shower system can be quickly and easily constructed and thereafter taken apart, moved and re-constructed in a different location.

The liquid impervious pan lies directly upon the ground. No frame or ground cover is required in the present invention, and therefore improves upon the prior art. Each pan further includes at least one small aperture axially aligning with an aperture of adjoining pan, permitting liquid fluidity among the entire system, regardless of the number of modular employed. At least one pan is connected to a pump and/or liquid removal device by a valve and pipe that in turn is in communication with a containment barrel or other liquid storage device. However, in a preferred embodiment, each pan along one side of the shower system has an aperture with an outlet valve inserted therein in communication with a pipe connected to a pump and liquid containment barrel to allow for greater withdrawal of liquids collected by the shower system. In an alternate embodiment, the apertures are not employed. Instead, a series of valves are provided, between each pan, allowing the user to control the flow of all fluids from tray to tray and the entire shower system.

When constructing a shower system wherein four corners of four separate pans adjoin, a brace, having a four leg, star like configuration is used to ensure a strong connection between the four pans. In a preferred embodiment, the brace employs four legs disposed at 90 degrees from each other. The aforementioned system would be applicable, for example, when two longitudinal columns of pans are employed in a constructed shower system. Further, a valve network can be provided at the four corner junction, proximal to the four leg brace, to again allow the user greater flexibility in controlling the direction and destination of fluids captured by the shower system in each pan. This aforementioned embodiment is extremely useful when two adjoining pans are capturing water or fluids of different types and it is desirous to maintain their separation. An example of this use is a hospital triage treating people or workers from two different infected sites of two different biological agents or chemicals.

Each pan further includes a drainage waffle disposed within a space created by the bottom layer and the four upstanding walls of the pan. The drainage waffle has a series of raised portions that define recesses between each raised portion, giving it a waffle-like configuration. A non-skid work surface, having a plurality of holes formed therein, allows water to flow through the work surface when positioned on a top portion of the drainage waffle. The work surface retains an adequate strength to support the targeted person, machine or other object to be cleansed by the inventive shower system.

Although the preferred embodiment for the present invention is a shower system, alternate uses for the pan can satisfy needs and deficiencies seen in the prior art. For example, the modular pans can be employed in the food industry underneath racks in refrigerators, freezers and meat lockers to capture any liquids spilling from said racks thereby avoiding contamination of the food contained therein. This would be most useful in the event of a power outrage to these food containment refrigeration systems. Further, the modular pans can be employed underneath stretchers in ambulances and treatment or surgery tables in both emergency and surgical rooms of hospitals and veterinarian clinics. Still further, the modular pans can be employed "in-line" in manufacturing facilities to capture leaks and spills of chemicals and other hazardous materials from fifty-five gallon drums. These hazardous liquids include, but are not limited to, lacquer thinners, industrial cleaners, solvents, oils, gasoline and diesel fuel.

BRIEF DESCRIPTION OF THE DRAWINGS

The detailed description of the invention, contained herein below, may be better understood when accompanied by a brief description of the drawings, wherein.

DETAILED DESCRIPTION OF THE PREFERED EMBODIMENT

Figure 1:
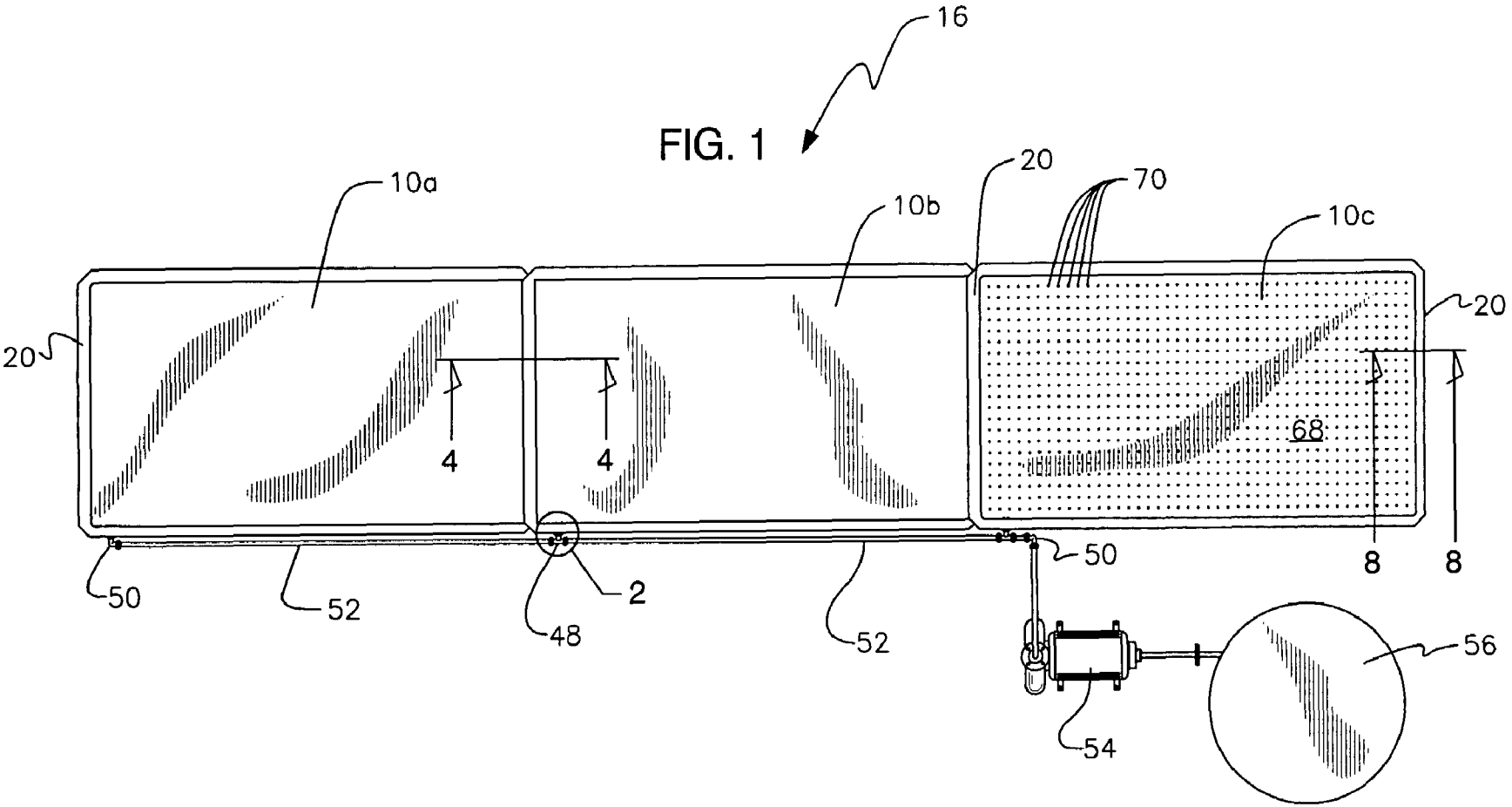
FIG. 1 is a top plan view of a hazardous and/or waste water collection and containment shower system of the present invention, illustrating the use of multiple modular pans or water impervious barriers.
Figure 7:
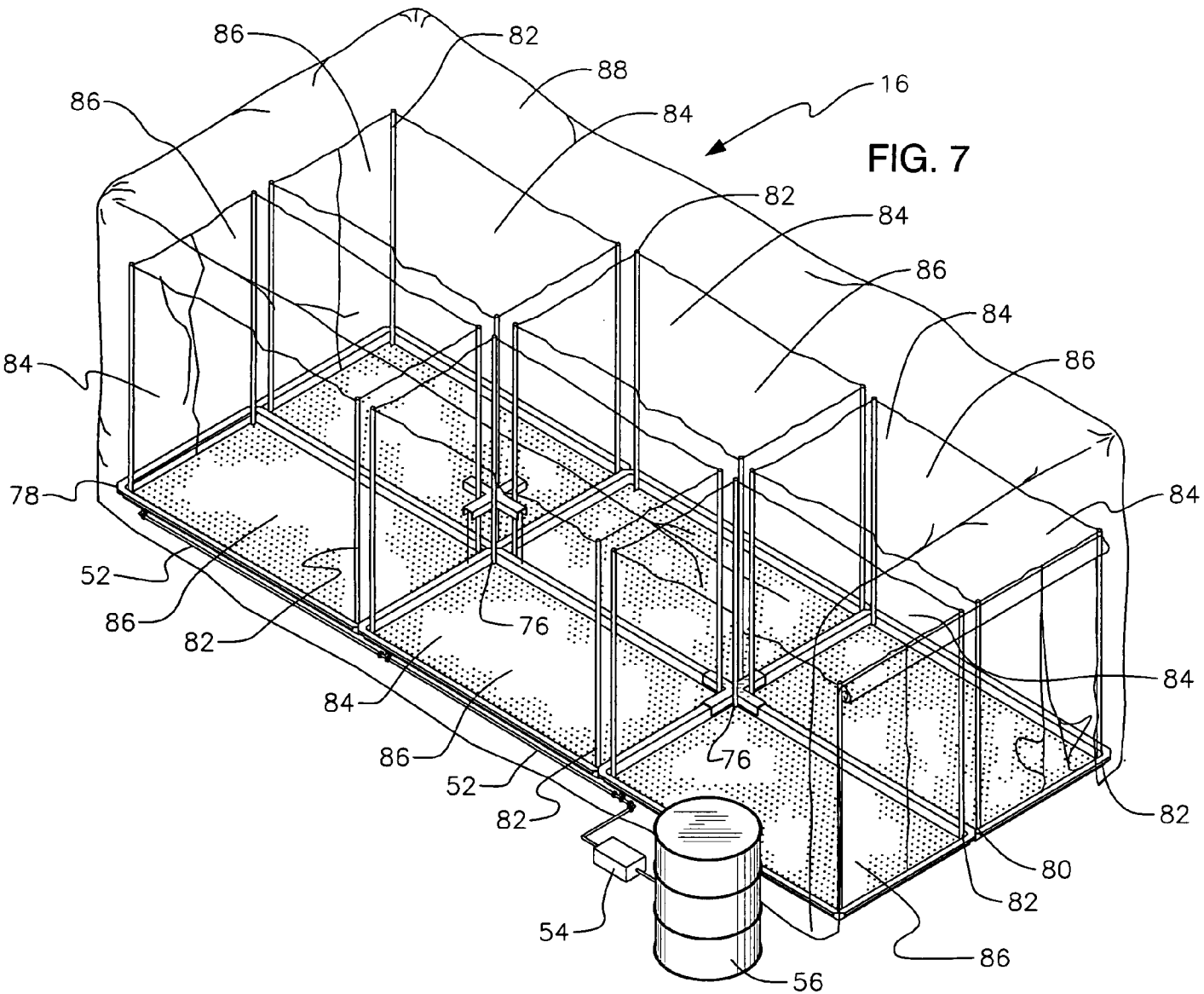
FIG. 7 is a perspective view, of a hazardous and/or waste water collection and containment shower system, of the present invention, employed in a "Hot Zone"

Referring to FIG. 1, a first modular pan 10*a* is affixed to a second modular pan 10*b* which in turn is affixed to a third modular pan 10*c* in a modular waste and hazardous water containment and collection shower system 16. The number of modular pans that can be affixed, or adjoined, in shower system 16 is a number equal to infinity. For the purpose of this application, applicant will refer to any given pan hereinafter as pan 10. A multitude of pans 10 can be connected in columns, as shown in FIG. 1, or in rows, or in both columns and rows, as shown in FIG. 7. Any configuration of both rows and columns can be employed in shower system 16, since the pans 10 are modular, and universally attachable to one another (as will be described hereinafter). Pan 10 is liquid impervious, capable of retaining the liquid it captures and constructed from a material such as, for example, HDPE, or high density polyethylene. Further, pan 10 is constructed from a material that is USDA and FDA approved and accordingly anti-bacterial.

Figure 4:
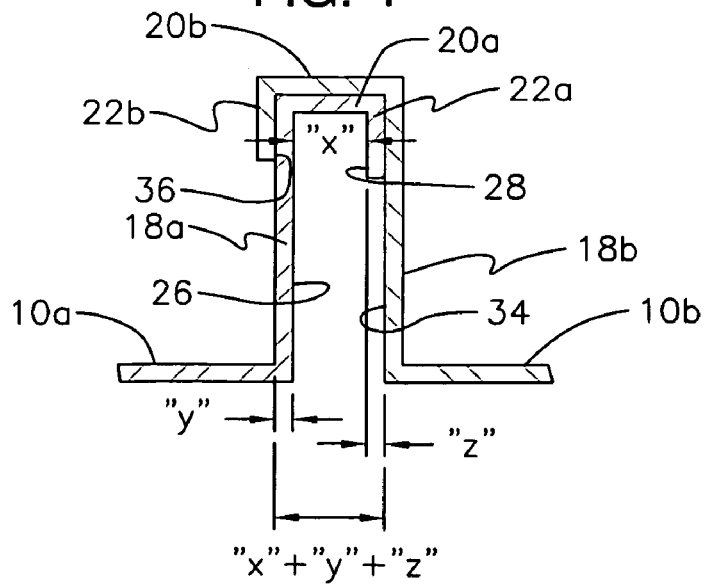
FIG. 4 is a cross-sectional view, along lines 4-4 of FIG. 1, illustrating how two modular pans interconnect by way of friction fit along top edges of upstanding walls thereof.

As shown in FIG. 4, a cross-sectional view along lines 4-4 of FIG. 1, each pan 10 has a plurality of upstanding walls 18 with horizontally disposed ledge members 20 and downward depending lips 22 of each wall 18. In the preferred embodiment, each pan 10 has four upstanding walls 18, four horizontally disposed ledge members 20 and four downwardly depending lips 22. Accordingly, in the preferred embodiment, pan 10 has four peripheral edges and is rectangular in shape. However, nothing herein limits the use of a pan 10 having more or less than four peripheral edges or shapes other than the preferred rectangular shape.

Figure 6:
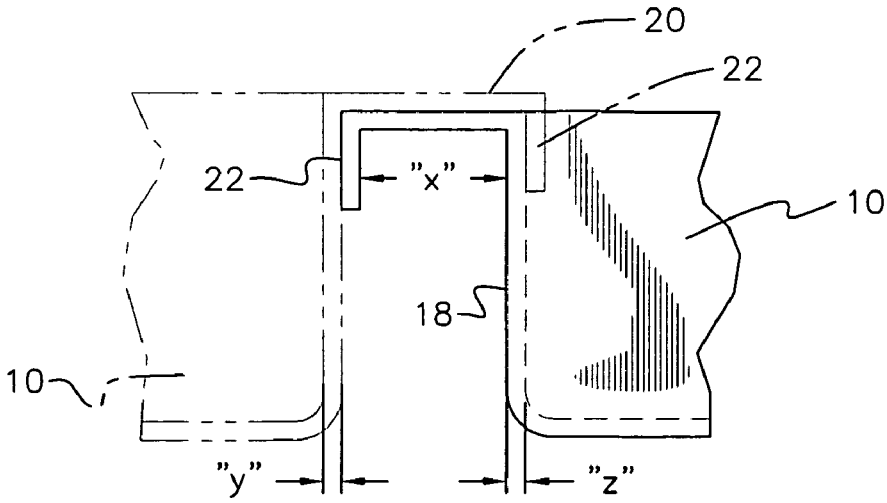
FIG. 6 is a side plan view, partially in section, of side edges of two modular pans illustrating the manner in which any two modular pans interconnect.

With continuing reference to FIG. 4, a first area 24, having a length defined as "x," is formed beneath horizontal ledge member 20 between an outer surface 26 of upstanding wall 18 and an inner surface 28 of downward depending lip 22 of a narrow peripheral edge 30. A second area 32, having a length defined as "x+y+z", is formed underneath horizontal ledge member 20 between an outer surface 34 of upstanding wall 18 and an inner surface 36 of downwardly depending lip 22 of a wide peripheral edge 38, wherein "y is defined as the thickness of upstanding wall 18 of narrow peripheral edge 30 and "z" is defined as the thickness of downwardly depending lip 22 of narrow peripheral edge 30. In the preferred embodiment, each pan 10 has two narrow peripheral edges 30 and two wide peripheral edges 38. As shown in FIG. 4, and as further illustrated by FIG. 6, wide peripheral edge 38 fits over narrow peripheral edge 30 thereby adjoining two pans 10 together by a friction fit.

Further to the preferred embodiment, wherein a rectangular-shaped pan is employed, each pan 10 is provided with two long peripheral edges and two short peripheral edges. As such, each pan 10 has one wide and narrow long peripheral edge (positioned opposed from one another) and one wide and narrow short peripheral edge (also positioned opposed from another). Accordingly, preferred pan 10, having a rectangular shape, is constructed with a first peripheral edge being short and wide, a second peripheral edge being long and wide, a third peripheral edge being short and narrow and a fourth peripheral edge being long and narrow. In this embodiment, the first and second peripheral edges have a common corner, the second and third peripheral edges have a common corner, the third and fourth peripheral edges have a common corner and the fourth and first peripheral edges have a common corner.

Figure 5:
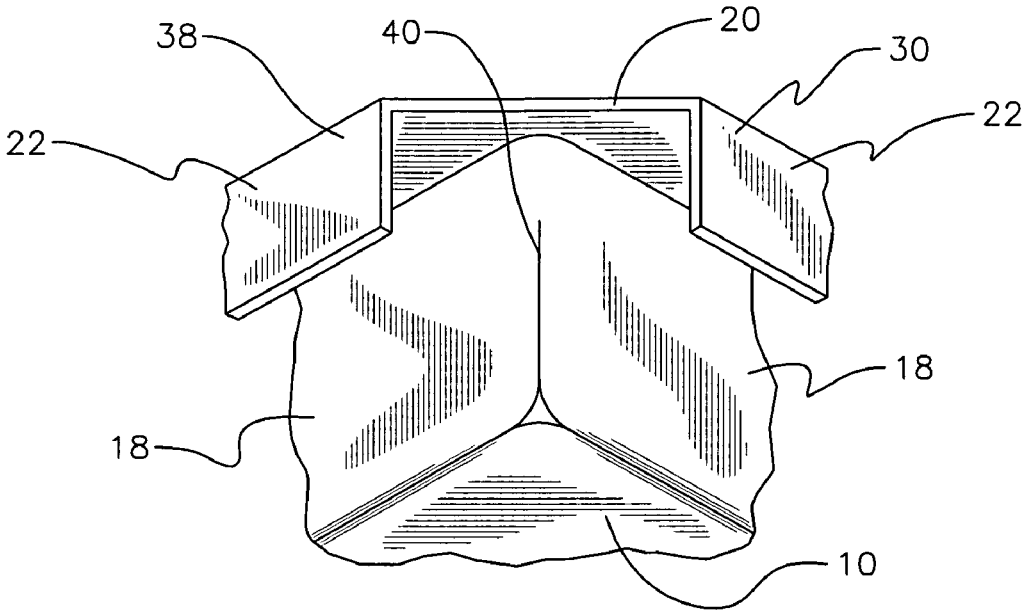
FIG. 5 is a perspective view of a corner section of a modular pan employed in the present invention.
Figure 5:
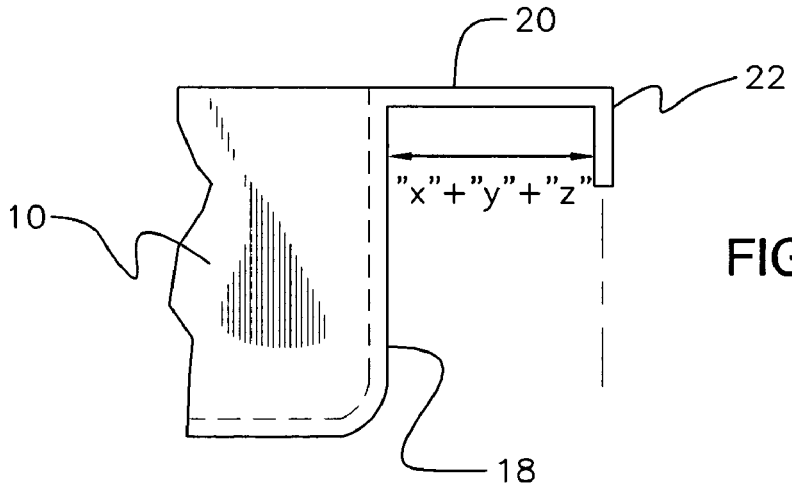

Referring to FIG. 5, a corner 40 is shown illustrating a wide peripheral edge 38 and a narrow peripheral edge 30 of preferred pan 10, such as the corner between the first and second peripheral edges. This preferred configuration allows pans 10 of similar construction to be attached to one another in any desired number, so long as a long and wide peripheral edge is connected to a long and narrow peripheral edge or a short and wide peripheral edge is connected to a short and narrow peripheral edge. As shown in FIG. 1, third pan 10*c* is connected to second pan 10*b* by third pan short and wide peripheral edge fitting over second pan short and narrow peripheral edge. And second pan 10*b* is connected to first pan 10*a* by second pan short and wide peripheral edge fitting over first pan short and narrow peripheral edge.

Figure 2:
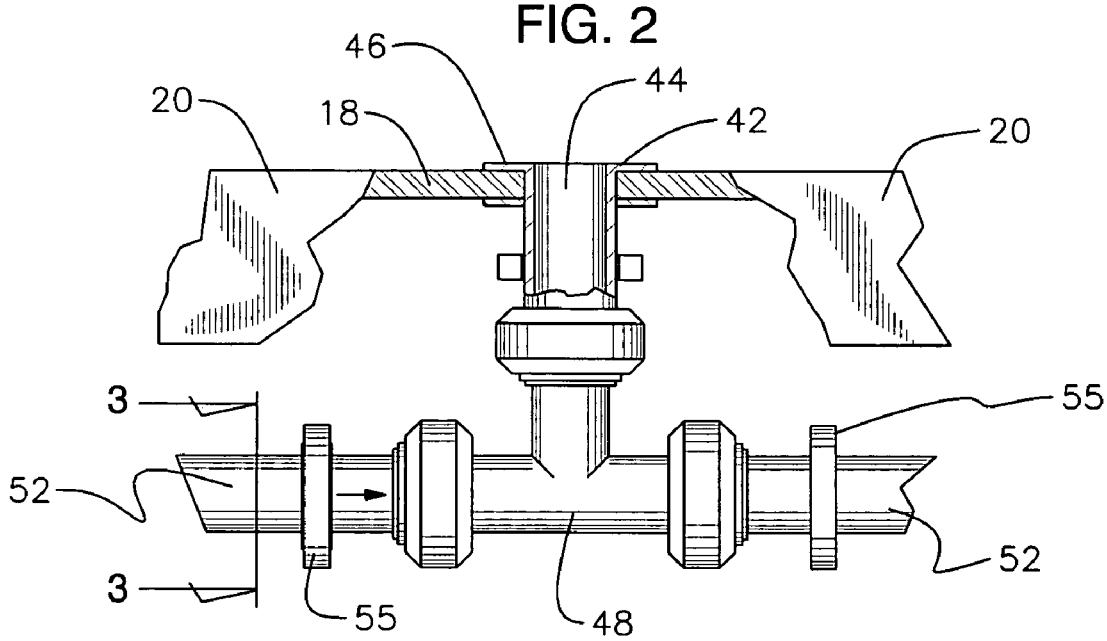
FIG. 2 is a top plan view, partially in section, of a valve connection employed in any one of the modular pans employed in the present invention.

Each pan can be provided with a system fluidity aperture (not shown) formed in one the upstanding walls 18. The apertures are positioned such that the system fluidity apertures of any two adjoining pans are axially aligned. For example, in FIG. 1, the system fluidity apertures, if employed, would be formed in the upstanding walls along the short peripheral edges where first pan 10*a* adjoins second pan 10*b* and second pan 10*b* adjoins third pan 10*c*. Further, a series of pump connection apertures 42 are formed in one of the long peripheral edges of each pan 10. As shown in FIG. 2, each pump connection aperture 42 has a piece of first tubing 44 inserted therein with a washer element 46 surrounding said first tubing 44 to ensure a water-tight fit at pump connection aperture 42. First tubing 44 is attached to T-connector 48. If first tubing 46 is inserted in a first pan 10*a* (see FIG. 1) then first tubing 46 attaches to an elbow connector 50. All of the T-connectors 48 and elbow connectors 50 are further attached to one another by a pipe network 52. And, pipe network 52 is attached to a pump 54 which in turn is connected to a storage container 56, such as, for example, a fifty-five gallon commercial barrel. Any aperture not used in any pan 10 can be plugged to ensure a complete liquid impervious seal to shower system 16.

Figure 3:
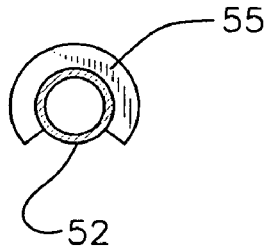
FIG. 3 is a cross section view of FIG. 2 along lines 3-3 of FIG. 2.

As shown in FIGS. 2 and 3, a quick release ring 55, having a shape of about a three-quarter circle, can be inserted near each connection point where first tubing 46 or the pipe network 52 attaches to any of the T-connectors 48 or elbow connectors 50 to permit easy and efficient retraction of the tubing or pipe from said connectors. In the preferred embodiment, first tubing 46 and the pipe network 52 is constructed from ⅜ inch PVC, although other materials and other sized pipes and tubing could be employed.

Figure 8:
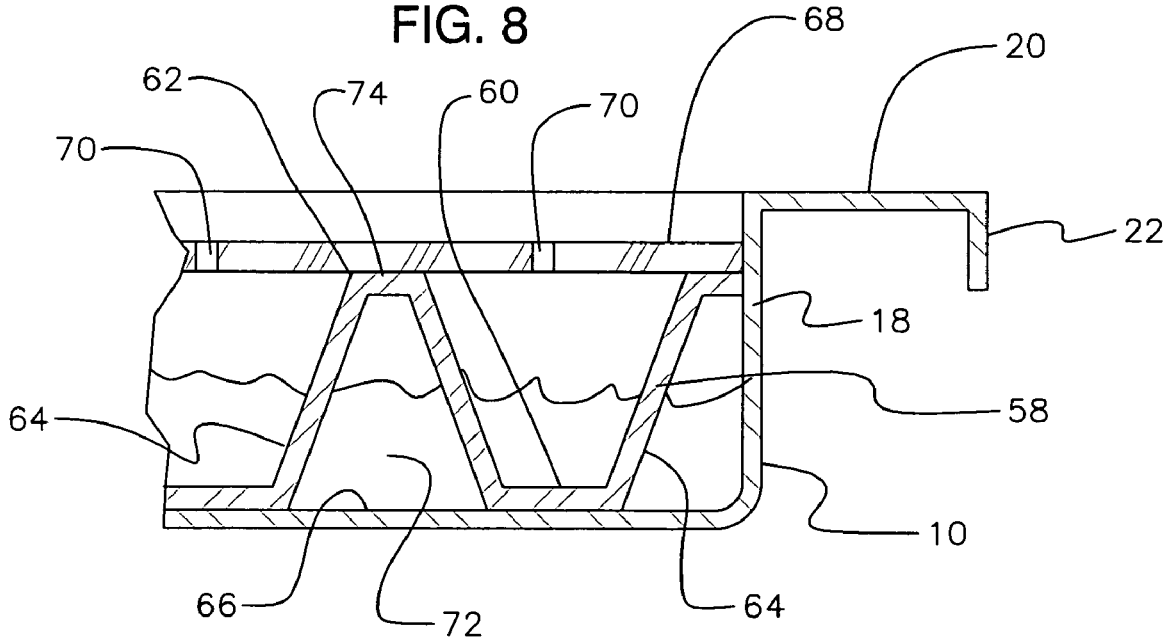
FIG. 8 is a cross-sectional view along lines 8-8 of FIG. 1, illustrating different layers employed in the present invention for capturing and collecting hazardous and/or waste water from a shower procedure.

Referring now to FIG. 8, a cross-sectional view along lines 8-8 of FIG. 1 is shown. As seen therein, pan 10 contains a drainage waffle 58 having a series of recesses 60 and protrusions 62 separated by upstanding angled walls 64. The continuous pattern throughout drainage waffle 58 gives this element its waffle-like appearance. Drainage waffle 58 fills an entire horizontal plane 66 defined by the four peripheral edges of pan 10. An overall height of drainage waffle 58 is slightly less tall than that of the pan upstanding walls 18, and therefore does not exceed the height of the pan horizontally disposed ledge members, as clearly seen in FIG. 8. Drainage waffle 58 includes a top surface 74 on which a non-skid work surface 68 is applied. Work surface 68 has an area equal to the area of the horizontal plane 66 of pan 10 and accordingly covers drainage waffle 58 in its entirety. Work surface 68 further includes a plurality of liquid drainage holes 70 formed throughout for permitting liquid 72 contacting the work surface 68 to drain into pan 10 through drainage waffle 58. Pan 10 captures the liquid 72, retains it therein, until pump 54 extracts it out through the first tubing 44 and pipe network 52 and into storage container 58. This allows the hazardous liquids captured to be expelled during the decontamination process ensuring that emergency workers utilizing system 16 are not be further exposed thereto by standing in ankle deep contaminated water. The workers are elevated above the captured pool of hazardous liquid on top of the non-skid work surface 68. At all times, the captured hazardous liquids are withdrawn below the work surface 68.

Referring now to FIG. 7, a shower system 16 of the present invention is shown. This type of system is very useful as a "Hot Zone" shower system used by organizations, such as, HAZMAT. Shower system 16 employs a plurality of pans 10 adjoined as previously described above. In the preferred shower system 16, rectangular-shaped pans 10 are employed. In FIG. 7, a three column, two row configuration is employed. However, it is understood that any configuration of columns and rows can be employed, as previously described, due to the modular design of the pans 10. In the shower system 16 of FIG. 7, a four legged brace member 76 is used to join four separate pans 10 together at four corners, one corner 40 each for each pan 10. Although not necessary and also not shown, a two legged brace can be employed at first and second opposed ends, 78 and 80 respectively, to secure two pans 10 that meet at such opposed ends 78 and 80.

With continuing reference to FIG. 7, a series of poles 82 are provided for supporting an enclosure 84 wrapped around each pan 10. Enclosures 84 can be fitted around each pan 10, as shown in FIG. 7, or around two or more pans, depending on the needs of the user. The preferred shower system 16 of FIG. 7 uses individual enclosures 84 for each pan 10 so that six separate shower stalls 86 are provided. In this arrangement, two workers can each enter separate first shower stalls located side by side one another for a first rinsing shower at first end 78. Without leaving the shower system 16, the two workers can then enter a second cleansing shower in separate second shower stalls. Thereafter, they can enter a third final rinsing shower in separate third shower stalls before exiting the shower system 16. Each shower stall is equipped with a shower head for providing a water source and a cleansing agent. If desired, although not necessary, a single outer enclosure 88 is provided for surrounding the entire shower system 16 as shown in FIG. 7.

As discussed before, when in operation, shower system 16, as seen in FIG. 7, captures the water from any rinsing or cleansing procedures carried out in pan 10. Pump 54 is activated during a rinsing and cleansing procedure. If the system fluidity apertures are used, an entire network of fluidity in shower system 16 is provided, and all water from all stalls 86 is withdrawn therefrom. It is recommended that pump 54 remain activated for a period of time after the rinsing and cleansing procedures have terminated in stalls 86 to evacuate all waste water. However, this is not necessary, since pans 10 could adequately retain the waste water therein and evacuate what water remains during the beginning of the next rinsing procedure. Further, a fluid sensor can be employed in system 16 or in each pan 10 that works to automatically activate pump 54 when a certain threshold level of liquid is reached or exceeded in pan 10. Or, an audible or visual alarm can be signaled by the sensor for manual activation of pump 54.

Figure 10:
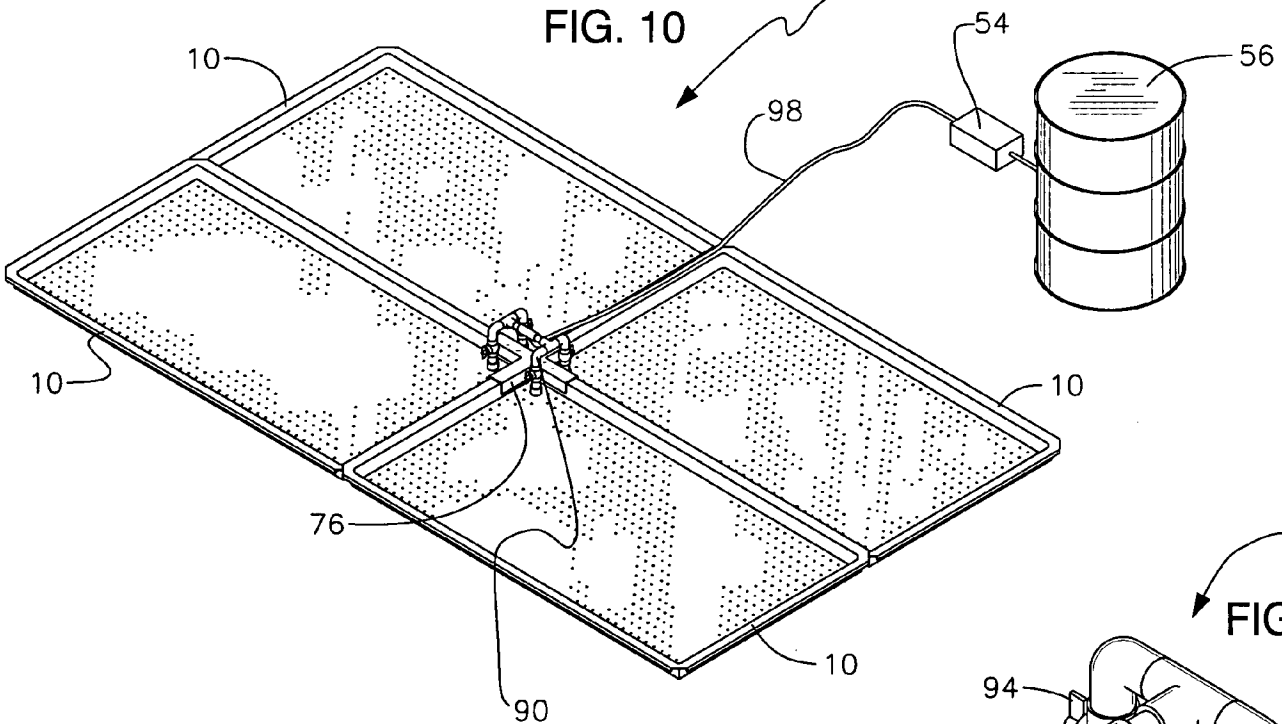
FIG. 10 is a perspective view of a shower system of the present invention illustrated in FIG. 9 when attached.
Figure 11:
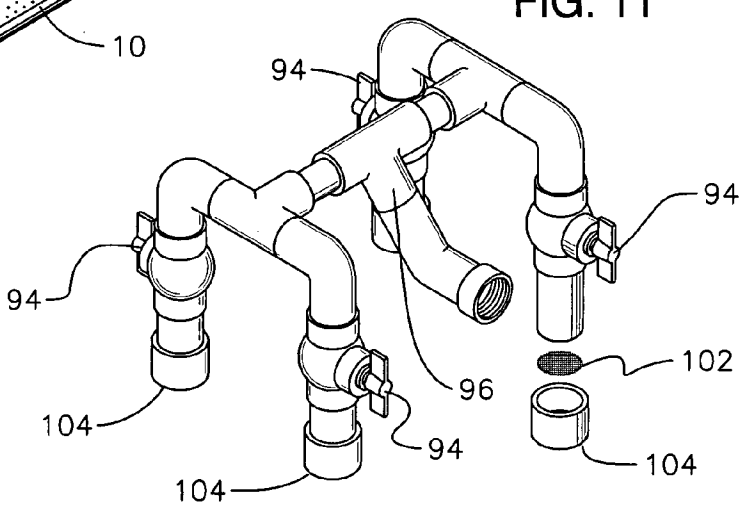
FIG. 11 is a perspective view of a valve network employed in the system of the present invention.

In an alternate embodiment, the system fluidity apertures are not used. Instead, as shown in FIG. 10, a valve network 90 (a close-up of which is seen in FIG. 11) is employed. Valve network 90 has one valve 92 for each pan 10 that is used in the system. In other words, there are as many valves 92 as pans 10 employed in the system. For example, in a four pan 10 configuration, valve network 90 has four valves 92, each with a flow control knob 94 for opening or closing its respective valve 92. All four valves 92 are linked by a common connection 96 which in turn connects to a conduit 98. Conduit 98 connects to pump 54 which connects to storage container 56. As further shown in FIGS. 9 and 10, valve network 90 conveniently connects to all four pans 10 by lying over a top portion 100 of brace member 76 such that one of each four valves 92 bisects two legs of the brace member 76. In a two pan configuration, a valve network of two valves would be employed (not shown).

Figure 9:
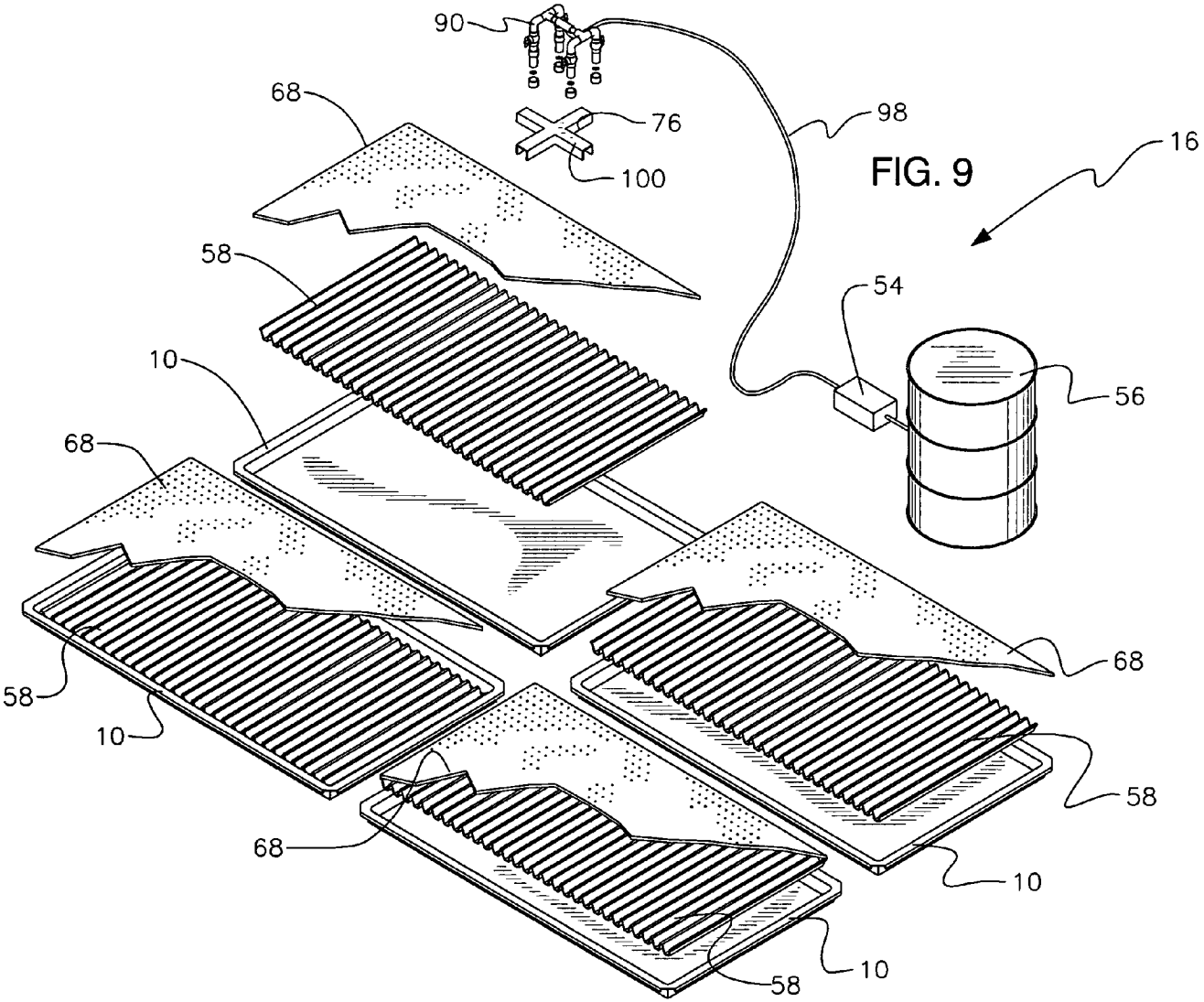
FIG. 9 is an exploded, perspective view of a four pan shower system of the present invention illustrating a fluid valve extraction network employed in an alternate embodiment herein.

As shown in FIGS. 9 and 11, valve screens 102 are employed within each valve 92 at a suction base 104. The valve suction base 104 provides an outlet for the liquid captured by pan 10 when pump 54 is engaged. In this embodiment, the fluid sensors can be employed in suction base 104 to automatically activate pump 54 or to signal an audible or visual alarm.

The flow control knobs 94 for each valve 92 allow the user to have complete control over the flow of liquids in the system. Accordingly, the user can decide which fluids can or should be mixed when withdrawn and when. For example, if four separate liquids are being captured by the system illustrated in FIGS. 10 and 11, each liquid can be withdrawn at separate intervals thereby eliminating the possibility of cross-contamination or the mixture of two or more liquids whose mixture may provide an even more hazardous compound. Valves 92 can also be used to move liquid from one pan 10 to any other pan 10 common to its valve network 90. Further, valves 92 are manually operated as shown in FIGS. 9, 10 and 11 by flow control knobs 94. However, nothing herein limits the use of computer controlled valves that could be programmed to open and close based upon threshold characteristics being exceeded or met. These threshold characteristics include, but are not limited to, moisture, heat, volume of liquid or type of chemical/liquid detected present within pan 10.

As to other potential uses of the inventive system described herein, the modular pans 10 can be employed in a host of other environments without departing from the general scope of the invention. These uses include deploying the pans 10 underneath stretchers and gurneys in hospitals and ambulances for both humans and animals. Use of pans 10 herein could help maintain a sterile environment. Further, pans 10 can be treated with pharmaceutical agents or aspects to even further decrease cross-contamination. Or, pans 10 can be installed in the food storage industry underneath the food storage racks within freezers, refrigerators and meat lockers.

Equivalent elements can be substituted for ones set forth herein to achieve the same results in the same way and in the same manner.

The invention claimed is:

1. A modular waste water and hazardous chemical containment and collection system comprising:

a) at least one modular pan having a planar bottom surface, a multitude of vertically disposed walls integrally attached to the planar bottom surface at bottom edges of said walls, a multitude of horizontally and outwardly disposed ledge members, one ledge member integrally attached to each vertically disposed wall at a top edge of each wall and a multitude of downwardly depending lips, one lip integrally attached to each ledge member at an outer edge of said lip;

b) a horizontal plane of each modular pan defined by the pan planar bottom surface and the multitude of vertically disposed walls;

c) a drainage waffle inserted within each of the at least one modular pan, the drainage waffle covering the pan horizontal plane and having a plurality of recesses and protuberances defined by a top surface, a bottom surface and upwardly angled walls connecting said top and bottom surfaces, the drainage waffle having a height;

d) a work surface covering the top surface of the drainage waffle and having a plurality of liquid drainage holes formed throughout said work surface, said holes permitting liquids that contact said work surface to drain through said work surface and into an area of the modular pan containing the drainage waffle, the work surface having a thickness which when added to the height of the drainage waffle equals a height defined as the total height of layers, the total height of layers not exceeding the height of the multitude of vertically disposed walls;

e) a means for withdrawing liquids from the at least one modular pan;

f) a pump connected to said means for withdrawing liquids;

g) a storage container connected to said pump for retaining liquids withdrawn by the pump and captured by the at least one modular pan;

h) the at least one modular pan having four peripheral edges, two of the peripheral edges having a long length and two of the peripheral edges having a short length, the two long and the two short peripheral edges defining a rectangular shape for the at least one modular pan;

i) one of the two long peripheral edges and one of the two short peripheral edges each having a first area disposed underneath the horizontally and outwardly disposed ledge members of each said long and short peripheral edge, the first area having a length defined as "x", wherein "x" is the distance between an outer surface of the vertically disposed wall and an inner surface of the downwardly depending lip of each respective long and short peripheral edge, the peripheral edges having said first area length defined as "x" being narrow peripheral edges of said pan; and j) an other of the two long peripheral edges and an other of the two short peripheral edges each having a second area disposed underneath the horizontally and outwardly disposed ledge members of each said other long and short peripheral edge, the second area having a length defined as "x +y +z", wherein "x" is the distance between the outer surface of the vertically disposed wall and the inner surface of the downwardly defending lip of each long and short narrow peripheral edge, "y" is a thickness of each vertically disposed wall and "z" is the thickness of each downwardly depending, the peripheral edges having said second area length defined as "x +y +z" being wide peripheral edges of said pan.

2. The modular waste water and hazardous chemical containment and collection system of claim 1, wherein at least two modular pans are employed, a first modular pan adjoining to a second modular pan by a wide peripheral edge of the first pan overlapping a narrow peripheral edge of the second pan, the wide peripheral edge of the first pan and the narrow peripheral edge of the second pan each having a length which is substantially equal.

3. The modular waste water and hazardous chemical containment and collection system of claim 1, wherein the means for withdrawing liquids from said at least one modular pan comprises:

a) an aperture formed in one of the multitude of vertically disposed walls;

b) a first tubing inserted in said aperture, said first tubing connected to a pipe element which is connected to the pump; and c) a means for providing a liquid tight seal at said aperture.

4. The modular waste water and hazardous chemical containment and collection system of claim 1, wherein the means for withdrawing liquids from said at least one modular pan is a valve network having at least one valve with a suction tube inserted into the at least one modular pan.

5. The modular waste water and hazardous chemical containment and collection system of claim 4, further comprising a valve screen inserted within the suction tube of the at least one valve.

6. The modular waste water and hazardous chemical containment and collection system of claim 1, further comprising a brace member inserted over a corner of at least two modular pans for maintaining a secure fit between the at least two pans.

7. The modular waste water and hazardous chemical containment and collection system of claim 6, wherein in the brace member has four legs, dispose at 90 degree angles from one another, the four-legged brace member fixing four corners of four separate pans at a common point.

8. The modular waste water and hazardous chemical containment and collection system of claim 7, wherein the means for withdrawing liquids from said at least one modular pan is at least one valve network, each of said at least one valve network having four valves, one valve each for four pans of said at least one modular pan.

9. The modular waste water and hazardous chemical containment and collection system of claim 8, wherein the at least one valve network is disposed over top of the four-legged brace member, each valve of the network having a suction tube and a valve control knob, one each valve suction tube inserted into one each pan for withdrawing liquids from said system.

10. The modular waste water and hazardous chemical containment and collection system of claim 1, further comprising:

a) a multitude of water sources, one water source for each of the at least one modular pan; and b) a plurality of enclosures, one enclosure for each of the at least one modular pan.

11. The modular waste water and hazardous chemical containment and collection system of claim 10, further comprising an outer enclosure surrounding all of the plurality of enclosures for each of the at least one modular pan.

12. A modular waste water and hazardous chemical containment and collection shower system, comprising:

a) at least one modular pan having a planar bottom surface, a multitude of vertically disposed walls integrally attached to the planar bottom surface at bottom edges of said walls, a multitude of horizontally and outwardly disposed ledge members, one ledge member integrally attached to each vertically disposed wall at a top edge of each wall and a multitude of downwardly depending lips, one lip integrally attached to each ledge member at an outer edge of said lip;

b) a horizontal plane of each modular pan defined by the pan planar bottom surface and the multitude of vertically disposed walls;

c) a drainage waffle inserted within each of the at least one modular pan, the drainage waffle covering the pan horizontal plane and having a plurality of recesses and protuberances defined by a top surface, a bottom surface and upwardly angled walls connecting said top and bottom surfaces, the drainage waffle having a height;

d) a work surface covering the top surface of the drainage waffle and having a plurality of liquid drainage holes formed throughout said work surface, said holes permitting liquids that contact said work surface to drain through said work surface and into an area of the modular pan containing the drainage waffle, the work surface having a thickness which when added to the height of the drainage waffle equals a height defined as the total height of layers, the total height of layers not exceeding the height of the multitude of vertically disposed walls;

e) a valve network for withdrawing liquids from the at least one modular pan;

f) a pump connected to said valve network;

g) a storage container connected to said pump for retaining liquids withdrawn by the pump through the valve network and captured by the at least one modular pan;

h) a multitude of water sources, one water source for each of the at least one modular pan;

i) the at least one modular pan having four peripheral edges, two of the peripheral edges having a long length and two of the peripheral edges having a short length, the two long and the two short peripheral edges defining a rectangular shape for the at least one modular pan;

j) one of the two long peripheral edges and one of the two short peripheral edges each having a first area disposed underneath the horizontally and outwardly disposed ledge members of each said long and short peripheral edge, the first area having a length defined as "x", wherein "x" is the distance between an outer surface of the vertically disposed wall and an inner surface of the downwardly depending lip of each respective long and short peripheral edge, the peripheral edges having said first area length defined as "x" being narrow peripheral edges of said pan; and k) an other of the two long peripheral edges and an other of the two short peripheral edges each having a second area disposed underneath the horizontally and outwardly disposed ledge members of each said other long and short peripheral edge, the second area having a length defined as "x +y +z", wherein "x" is the distance between the outer surface of the vertically disposed wall and the inner surface of the downwardly defending lip of each long and short narrow peripheral edge, "y" is a thickness of each vertically disposed wall and "z" is the thickness of each downwardly depending, the peripheral edges having said second area length defined as "x +y +z" being wide peripheral edges of said pan.

13. The modular waste water and hazardous chemical containment and collection shower system of claim 12, further comprising a plurality of enclosures, one enclosure for each of the at least one modular pan.

14. The modular waste water and hazardous chemical containment and collection system of claim 12, wherein at least two modular pans are employed, a first modular pan adjoining to a second modular pan by a wide peripheral edge of the first pan overlapping a narrow peripheral edge of the second pan, the wide peripheral edge of the first pan and the narrow peripheral edge of the second pan each having a length which is substantially equal.

15. The modular waste water and hazardous chemical containment and collection shower system of claim 12, further comprising a plurality of valves of the valve network, each valve having a suction tube inserted into a separate pan of the at least one modular pan.

16. The modular waste water and hazardous chemical containment and collection system of claim 15, further comprising a valve screen inserted within each suction tube.

17. The modular waste water and hazardous chemical containment and collection system of claim 12, further comprising a brace member inserted over a corner of two pans of the at least two modular pans for maintaining a secure fit between said two pans.

18. The modular waste water and hazardous chemical containment and collection system of claim 17, wherein the brace member has four legs, dispose at 90 degree angles from one another, the four-legged brace member fixing four corners of four separate pans at a common point of the at least two modular pans.

* * * * *